US008624801B2

(12) United States Patent
Guo et al.

(10) Patent No.: US 8,624,801 B2
(45) Date of Patent: Jan. 7, 2014

(54) PIXEL STRUCTURE HAVING A TRANSISTOR GATE VOLTAGE SET BY A REFERENCE VOLTAGE

(75) Inventors: Hong-Ru Guo, Tainan (TW); Ming-Chun Tseng, Tainan (TW); Chien-Hsiang Huang, Tainan (TW)

(73) Assignees: Chimei Innolux Corporation (TW); Chi Mei EI Corporation (TW)

( * ) Notice: Subject to any disclaimer, the term of this patent is extended or adjusted under 35 U.S.C. 154(b) by 1339 days.

(21) Appl. No.: 11/655,329

(22) Filed: Jan. 19, 2007

(65) Prior Publication Data

US 2007/0164940 A1 Jul. 19, 2007

(30) Foreign Application Priority Data

Jan. 19, 2006 (TW) ..... 95102124 A

(51) Int. Cl.
*G09G 3/30* (2006.01)

(52) U.S. Cl.
USPC ..... 345/76

(58) Field of Classification Search
USPC ..... 345/92, 211–214, 76–84
See application file for complete search history.

(56) References Cited

U.S. PATENT DOCUMENTS

| | | | | |
|---|---|---|---|---|
| 6,232,939 | B1 | 5/2001 | Saito | |
| 6,501,456 | B1 | 12/2002 | Saito | |
| 7,245,278 | B2 | 7/2007 | Hu | |
| 2003/0117082 | A1 | 6/2003 | Tam | |
| 2004/0207614 | A1 * | 10/2004 | Yamashita et al. | 345/211 |
| 2005/0057456 | A1 | 3/2005 | Hu | |
| 2005/0116692 | A1 * | 6/2005 | Sugiyama | 323/222 |
| 2005/0258466 | A1 * | 11/2005 | Kwak et al. | 257/306 |
| 2006/0071887 | A1 * | 4/2006 | Chou | 345/82 |
| 2006/0139251 | A1 * | 6/2006 | Morosawa et al. | 345/76 |

FOREIGN PATENT DOCUMENTS

| | | |
|---|---|---|
| EP | 1385141 | 1/2004 |
| JP | 6208335 | 7/1994 |

* cited by examiner

*Primary Examiner* — Dennis Joseph
(74) *Attorney, Agent, or Firm* — Trop Pruner & Hu, P.C.

(57) ABSTRACT

A display device comprises a pixel structure. The pixel structure includes a first transistor having a gate and circuitry to initially set the first transistor gate at a first voltage. In response to a data signal received over a data line of the display device, the first transistor gate is set at a second voltage. The first transistor gate voltage transitions from the second voltage to a third voltage that is higher than the second voltage by a reference voltage. A light element is coupled to the first transistor and configured to emit light in response to a current through the light element.

20 Claims, 15 Drawing Sheets

10

PIXEL STRUCTURE HAVING A TRANSISTOR GATE VOLTAGE SET BY A REFERENCE VOLTAGE

CROSS-REFERENCE TO RELATED APPLICATION

This claims priority under 35 U.S.C.§119 of Taiwan application Serial No. 95102124, filed Jan. 19, 2006, which is incorporated herein by reference.

TECHNICAL FIELD

The invention relates in general to a display apparatus and pixel driving method thereof, and more particularly to a display apparatus capable of reducing period time of a scan signal.

BACKGROUND

Various types of display devices are either available or being proposed. One such type of display device is an organic light emitting diode (OLED) display device. An OLED is a special type of light emitting diode (LED) in which the light emissive layer is formed of a thin film of organic compounds. An OLED display device has a matrix of pixels, where each pixel includes an OLED and other circuitry.

Referring to FIG. 1, a circuit diagram of a conventional pixel 10 is shown, which includes an organic light emitting diode (OLED) D1, capacitors C1 and C2 and transistors Q1-Q4. The transistors Q1 Q4 are p-type thin film transistors (TFTs). The transistor Q2 is for outputting an operational current I1 to the OLED D1. The OLED D1 has a negative end coupled to a source voltage Vss1 and a positive end coupled to a drain of the transistor Q1. The transistor Q1 has a gate for receiving an activation/deactivation signal (MRG) and a source coupled to a drain of the transistor Q2 and a source of the transistor Q4. A gate of the transistor Q4 is for receiving a reset signal RST.

The transistor Q2 has a source coupled to a source voltage Vdd1 and one end of the capacitor C2, and a gate coupled to the other end of the capacitor C2, a drain of the transistor Q4 and one end of the capacitor C1. The capacitor C1 has the other end coupled to a source of the transistor Q3. The transistor Q3 has a gate for receiving a scan signal SCT(n) and a drain for receiving a DAT signal.

Referring to FIG. 2, a timing diagram of a conventional pixel is shown. In order to compensate for the effect of a transistor threshold voltage on the operational current, the above MRG signal, reset signal RST, scan signal SCT(n) and DAT signal operate according to a timing sequence as shown in FIG. 2. The sequence of signals is used for successively enabling the transistors Q1~Q4 and resetting a gate voltage Vg2 of the transistor Q2 to be (Vdd1−Vth) in a period T1.

When the gate voltage Vg2 of the transistor Q2 is reset to be (Vdd1−Vth), the drain of the transistor Q3 receives a DAT signal, which is a to-be-written pixel data voltage Vdata, in a period T2. After the period T2, the transistor Q2 outputs an operational current I1 to the OLED D1. Because the gate voltage Vg2 of the transistor Q2 is reset beforehand to be (Vdd−Vth), the operational current I1 will not be affected by the threshold voltage when outputted by the transistor Q2.

The period length of the pixel data voltage Vdata is equal to the period T2, but the period length of the scan signal SCT(n) is equal to the period T1 plus the period T2. As the period of the scan signal SCT(n) becomes longer, the frame response speed will become lower. Frame response speed refers to the response speed of a display device in displaying successive video frames. As a result of the low frame response speed, the pixel 10 cannot be applied to a display of high resolution or large size.

DETAILED DESCRIPTION

Figure 1:
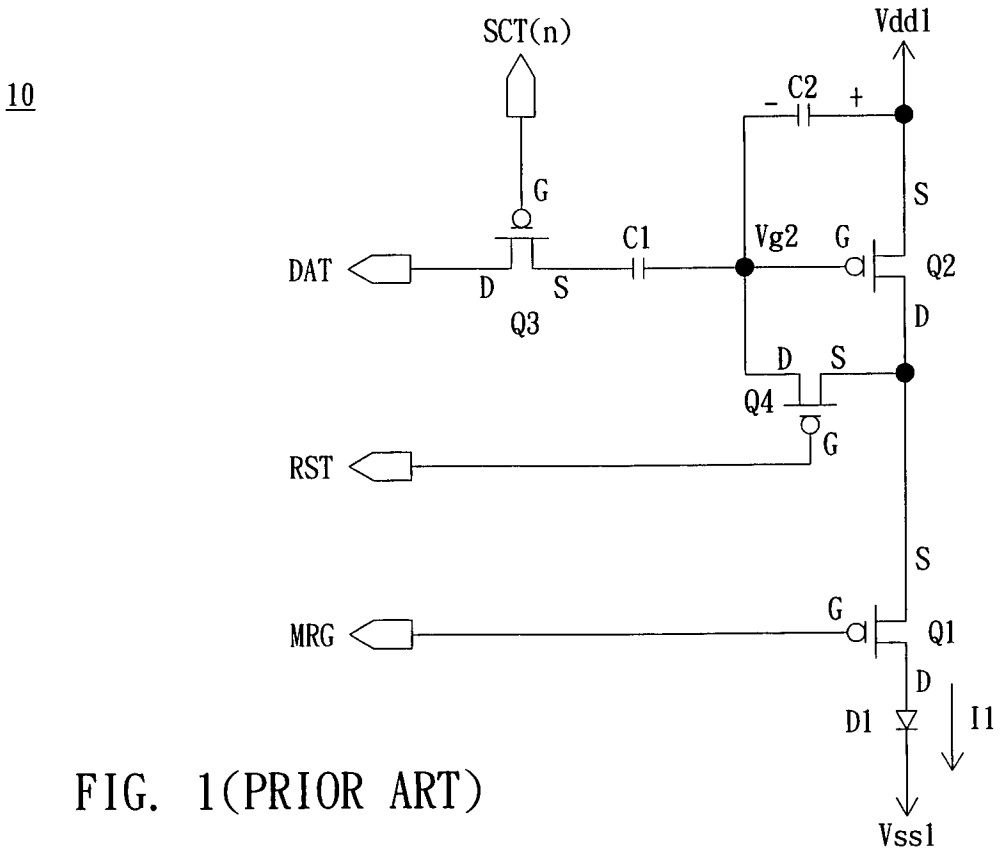
FIG. 1(PRIOR ART)
FIG. 1 is a circuit diagram of a conventional pixel.
Figure 2:
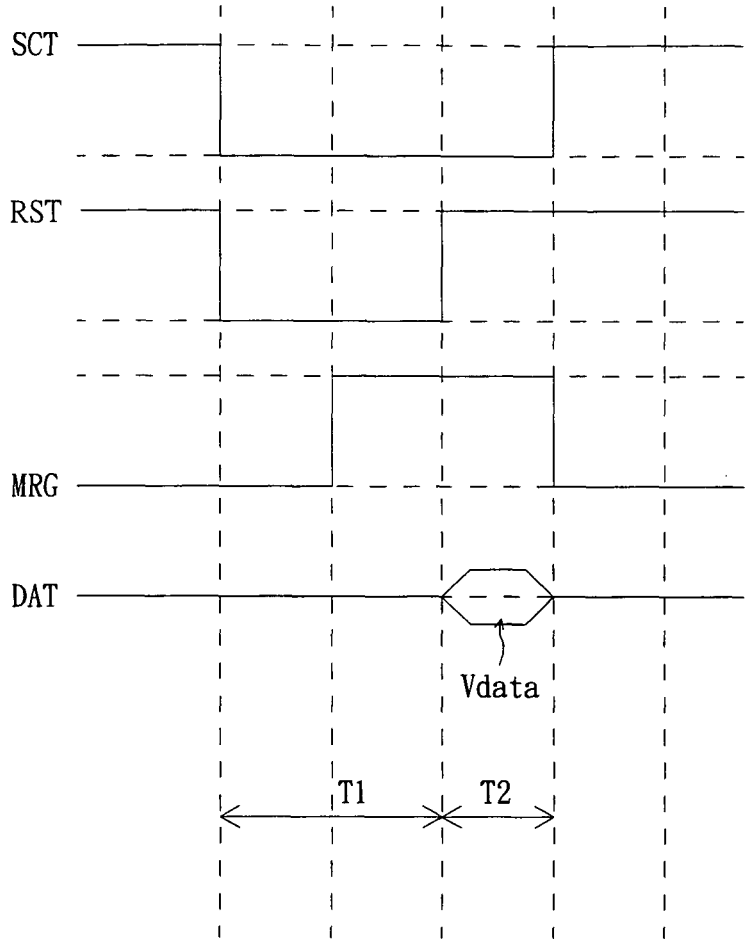
FIG. 2(PRIOR ART)
FIG. 2 is a timing diagram relating to operation of the conventional pixel.
Figure 3:
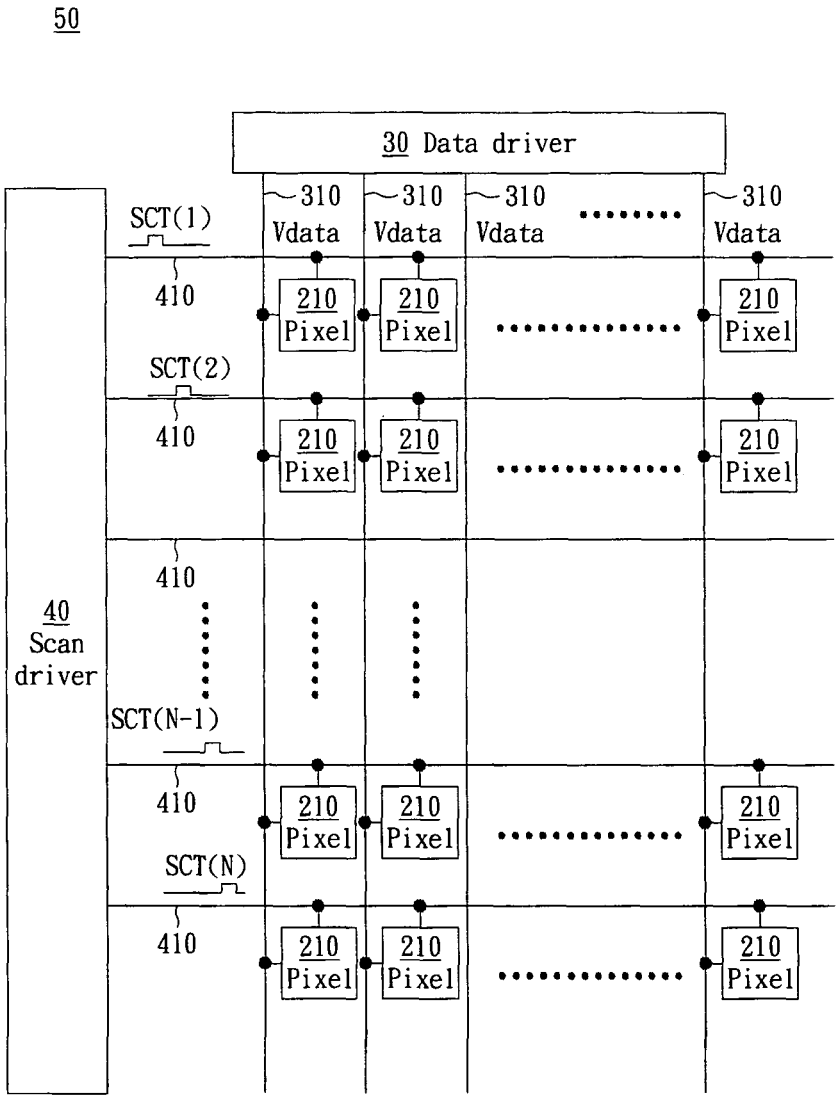
FIG. 3 is a schematic diagram of a first display device that includes pixels according to some embodiments.

Referring to FIG. 3, a schematic diagram of a first display device 50, which can be an organic light emitting diode (OLED) device, is shown. The display device 50 includes a data driver 30, data lines 310, a scan driver 40, scan lines 410 and pixels 210. The scan driver 40 outputs scan signals SCT (n) over the scan lines 410 to drive each row of pixels 210, wherein n=1~N. The data driver 30 outputs pixel data voltages Vdata over the data lines 310 to the pixels (also referred to as "pixel structures") 210 to display a frame with desired luminance after the scan driver 40 has driven the pixels 210.

A pixel structure of an OLED device includes a light element (that emits light), with the light element being an OLED. An OLED has a light emissive layer that is formed of organic compound(s).

Embodiment One

Figure 4:
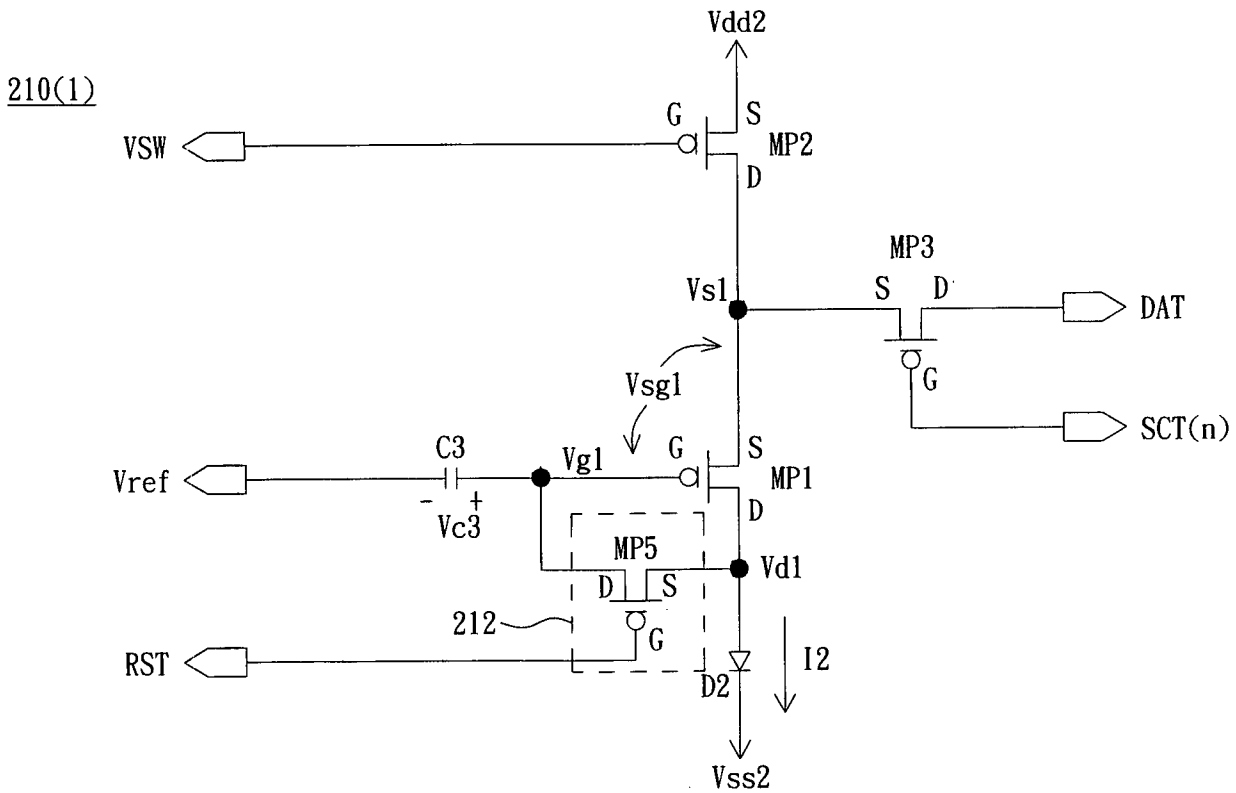
FIG. 4 is a circuit diagram of a first pixel structure according to a first embodiment of the invention.

Referring to FIG. 4, a circuit diagram of a first pixel structure according to a first embodiment of the invention is shown. The first pixel structure 210(1) includes a reset circuit 212, first transistor MP1, second transistor MP2, third transistor MP3, light element D2 (e.g., organic light emitting diode), and capacitor C3. The reset circuit 212, which includes a fifth transistor MP5 in the embodiment, is for compensating a threshold voltage Vth of the first transistor MP1. The transistors MP1~MP5 can be p-type TFTs (thin-film transistors) in one example embodiment.

The light element D2 has a negative end coupled to a source voltage Vss2 (e.g., a low power supply voltage such as ground) and a positive end coupled to a drain of the first transistor MP1 and a source of the fifth transistor MP5.

As used here, the term "drain" can refer to either a drain or source of a transistor; similarly, a "source" can refer to either a drain or source of a transistor.

The fifth transistor MP5 has a gate for receiving a reset signal RST. The fifth transistor MP5 is for resetting a gate voltage Vg1 of the first transistor MP1 to be (Vdata−Vth) in cooperation with other transistors, wherein (Vdata−Vth) is a reset voltage, and Vth is a threshold voltage of the first transistor MP1. The fifth transistor MP5 has a drain coupled to one end of the capacitor C3 and a gate of the first transistor MP1. The capacitor C3 has its other end for receiving a reference voltage signal Vref.

The first transistor MP1 has a source coupled to a source of the third transistor MP3 and a drain of the second transistor MP2. The third transistor MP3 has a gate coupled to the corresponding scan line 410 for receiving a respective scan signal SCT(n). For example, when the pixel structure 210(1) is positioned in the first row of the organic light emitting display 50, the pixel structure receives the present scan signal SCT(1), and when the first pixel structure 210(1) is positioned at the second row of the organic light emitting display 50, the pixel structure receives the respective scan signal SCT(2). Generally, a pixel structure 210(1) positioned in row n receives scan signal SCT(n). The transistor MP3 has a drain coupled to the corresponding data line 310 for receiving the pixel data voltage Vdata.

The second transistor MP2 has a source coupled to a source voltage Vdd2 and a gate for receiving a power switch signal VSW to couple the gate of the first transistor MP1 to the source voltage Vdd2 (e.g., a high power supply voltage). The RST and VSW signals are provided by circuitry that can be part of the display panel or circuitry outside the display panel. Note also that Vdd2 and Vss2 depicted in FIG. 4 can be power supply voltages, where Vdd2 is higher than Vss2.

Figure 5:
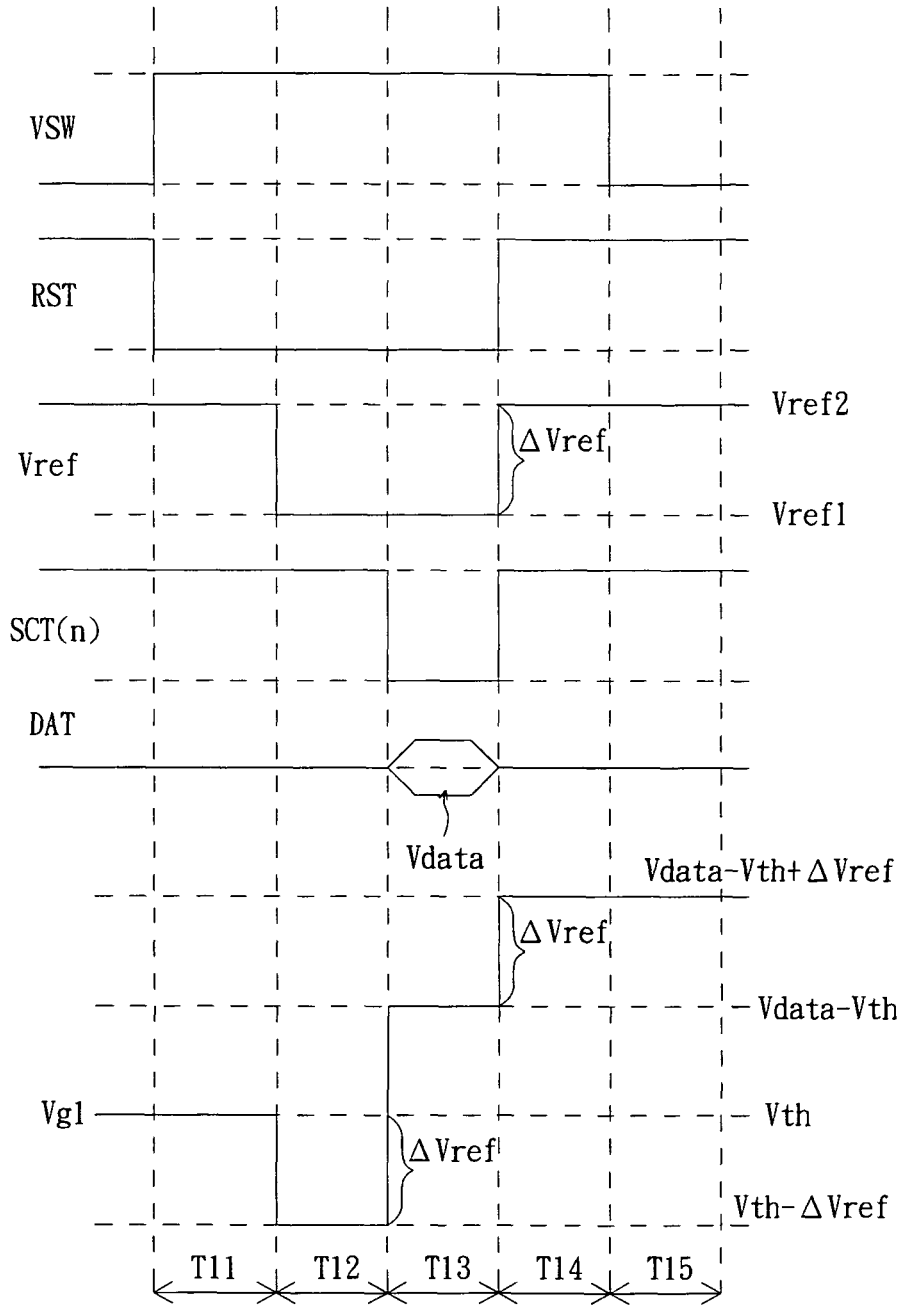
FIG. 5 is a timing diagram relating to operation of the first pixel structure.

Referring to FIG. 5, a timing diagram relating to operation of the first pixel structure 210(1) is shown. The timing device includes periods T11, T12, T13, T14 and T15 in sequence.

In period T11, the power switch signal VSW has a high voltage level (inactive voltage) to turn off the second transistor MP2. The scan signal SCT(n) is also at a high voltage level to turn off the third transistor MP3. The reset signal RST has a low voltage level (active voltage) to turn on the fifth transistor MP5. The reference voltage signal Vref is set equal to the second reference voltage Vref2 such that the voltage at the negative end of the capacitor C3 is set at the second reference voltage Vref2. Moreover, the transistor MP1 has a gate voltage Vg1 that is equal to Vth due to the threshold voltage drop from the drain to gate of transistor MP1. As a result, the capacitor C3 has a storage voltage Vc3=Vth−Vref2.

In period T12, the power switch signal VSW and scan signal SCT(n) remain at a high voltage level such that the second transistor MP2 and third transistor MP3 continue to be turned off. The reset signal RST remains at a low level such that the fifth transistor MP5 continues to be turned on. The reference voltage signal Vref is changed to the first reference voltage Vref1 (Vref2>Vref1) such that the voltage of the capacitor C3 at the negative end is changed to the first reference voltage Vref1. Note that the reference voltage Vref1 can be a negative voltage (but it can be positive or at zero in other implementations). Because the capacitor C3 has a storage voltage Vc3=Vth−Vref2 in the period T11, the gate voltage Vg1 of the transistor MP1 is set as follows in period T12 due to transition of signal Vref from Vref2 to Vref1: Vg1=Vref1+Vc3=Vref1+Vth−Vref2=Vth−ΔVref, wherein ΔVref=Vref2−Vref1.

In other words, as a result of transition of Vref from Vref1 to Vref2, Vg1 drops by ΔVref, as depicted in period T12 of FIG. 5.

In period T13, the power switch signal VSW is still at a high level such that the second transistor MP2 continues to be turned off. The reset signal RST is still at a low level such that the fifth transistor MP5 continues to be turned on. The scan signal SCT(n) is transitioned to a low voltage level such that the third transistor MP3 is turned on. The pixel data voltage Vdata (provided over a data line 310 in FIG. 5) is inputted to the source of the first transistor MP1 via the third transistor MP3 such that Vs1=Vdata. The reference voltage signal Vref is still set at the first reference voltage Vref1 and thus the capacitor C3 still has a negative voltage equal to the first reference voltage Vref1. The transistor MP1 then has a reset gate voltage Vg1=Vdata−Vth such that the capacitor C3 has a storage voltage Vc3=Vg1−Vref1=Vdata−Vth−Vref1.

Since the scan signal SCT(n) needs only to be set at a low voltage (active voltage) for a period length equal to that of the pixel data voltage Vdata, the display device 50 can have a higher frame response speed to provide better image quality.

In period T14, the power switch signal VSW is still at a high level such that the second transistor MP2 continues to be turned off. The scan signal SCT(n) and reset signal RST transition to a high voltage level such that the third transistor MP3 and fifth transistor MP5 are turned off. The reference voltage signal Vref is switched from the first reference voltage Vref1 to the second reference voltage Vref2 which causes the negative end of the capacitor C3 to be changed to the second reference voltage Vref2. Since the capacitor C3 has a storage voltage Vc3=Vdata−Vth−Vref1 in the period T13, the gate voltage Vg1 of transistor MP1 is set to Vg1=Vref2+Vc3=Vref2+Vdata−Vth−Vref1=Vdata−Vth+ΔVref, where the Vdata−Vth+ΔVref is a set voltage.

Next, in period T15, the scan signal SCT(n) and reset signal RST are still at a high level such that the third transistor MP3 and fifth transistor MP5 continue to be turned off. The power switch signal VSW transitions to a low voltage level such that the second transistor MP2 is turned on. As a result, the source of the first transistor MP1 is coupled to a source voltage Vdd such that Vs1=Vdd2. As noted above, the gate voltage Vg1 of the transistor MP1 was set to Vdata−Vth+ΔVref in period T14, and thus the voltage Vsg1 across the source and drain of the first transistor MP1 is equal to Vdd2−Vg1=Vdd2−(Vref2+Vdata−Vth−Vref1)=Vdd2−Vdata−ΔVref+Vth. As a result, the current I2 of the light element D2 is $K\times(Vsg1-Vth)^2=K\times(Vdd2-Vdata-\Delta Vref+Vth-Vth)^2=K\times(Vdd2-Vdata-\Delta Vref)^2$, wherein K is a process transconductance parameter of the first transistor MP1.

As indicated above, the sequence of signals depicted in FIG. 5 allows the current I2 through the light element D2 to be based on the values of K, Vdd2, Vdata, and ΔVref. The current I2 does not depend on the threshold voltage Vth of transistor MP1. Stated differently, techniques according to some embodiments allow compensation for the threshold voltage Vth of MP1 such that the light element currents in the various pixels of the display device are not affected by variations in Vth of respective transistors MP1. Note that such variations in Vth can cause brightness of light produced by the light elements to vary, if the compensation technique according to some embodiments is not used.

Moreover, the value ΔVref is adjustable, and thus when the characteristics of the light element D2 differ, the value ΔVref can be adjusted so that the transistor MP1 can be adjusted to operate in a saturation region to prevent the current I2 from being changed along with the light element D2.

In addition, because the value ΔVref can control the amount of the current I2, the pixel data voltage Vdata, and source voltages Vss2 and Vdd2 outputted by the data driver 30 have a larger adjustable range such that the driving integrated circuits of the display device 50 has more options during design for reducing production cost.

Figure 6:
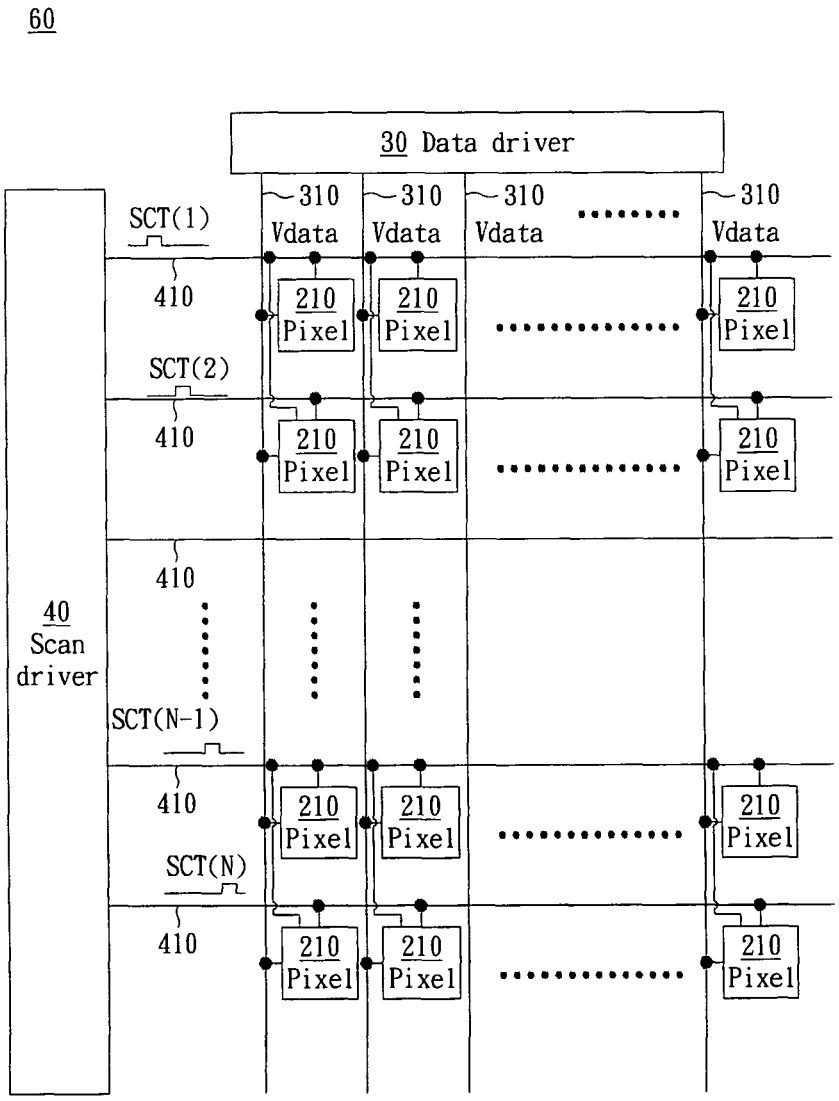
FIG. 6 is a schematic diagram of a second display device that includes pixels according to some embodiments.

Referring to FIG. 6, a schematic diagram of a second display device 60 (which can be an OLED display device) is depicted. The difference between the second display device 60 and the display device 50 is that in the second display device 60, a single row of pixels 210 receives both a present scan signal SCT(n) and a previous scan signal SCT(n−1). The present scan signal SCT(n) is a signal of the n-th scan line for row n, and the previous scan signal SCT(n−1) is a signal of the (n−1)-th scan line.

When the previous scan signal SCT(n−1) is generated, the pixel 210 has changed the gate voltage of the first transistor MP1 beforehand. When the present scan SCT(n) is generated, the pixel 210 can quickly complete the compensation for the threshold voltage Vth of the first transistor MP1.

For example, when the scan driver 40 outputs the scan signal SCT(1) to drive the first row of pixels 210, the scan signal SCT(1) is also outputted to the second row of the pixels 210. The second row of pixels 210 changes the gate voltage of the first transistor MP1 beforehand according to the scan signal SCT(1).

When the scan driver 40 outputs the scan signal SCT(2) to drive the second row of pixels 210, the pixels 210 can be reset much more quickly to set the second row of pixels 210 in order to speed up the frame response of the display device 60, which results in a better image quality accordingly.

Embodiment Two

Figure 7:
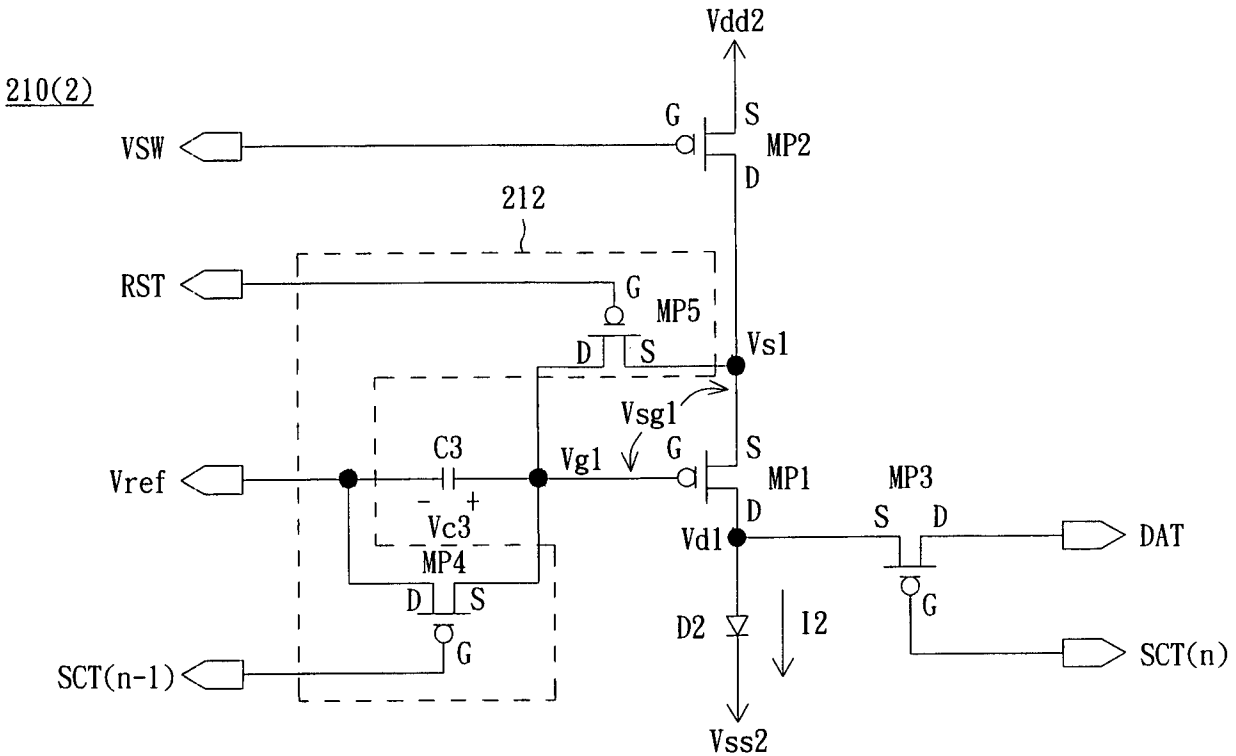
FIG. 7 is a circuit diagram of a second pixel structure according to a second embodiment of the invention.

Referring to FIG. 7, a circuit diagram of a second pixel structure 210(2) according to a second embodiment of the invention is shown. The difference between the second pixel structure 210(2) and the first pixel structure 210(1) is that in the second pixel structure 210(2), the third transistor MP3 has a source coupled to the drain of the first transistor MP1 and the positive end of the light element D2. In this embodiment, the reset circuit 212 includes two transistors: a fourth transistor MP4 and fifth transistor MP5. The transistors MP4 and MP5 are p-type TFTs in one example embodiment.

The fifth transistor MP5 has a source coupled to the drain of the second transistor MP2 and the source of the first transistor MP1, and a drain coupled to the positive end of the capacitor C3, the gate of the first transistor MP1 and the source of the fourth transistor MP4. The gate of the transistor MP5 is coupled to the signal RST. The fourth transistor MP4 has a drain for receiving the reference voltage signal Vref and a gate for receiving the previous scan signal SCT(n−1).

Figure 8:
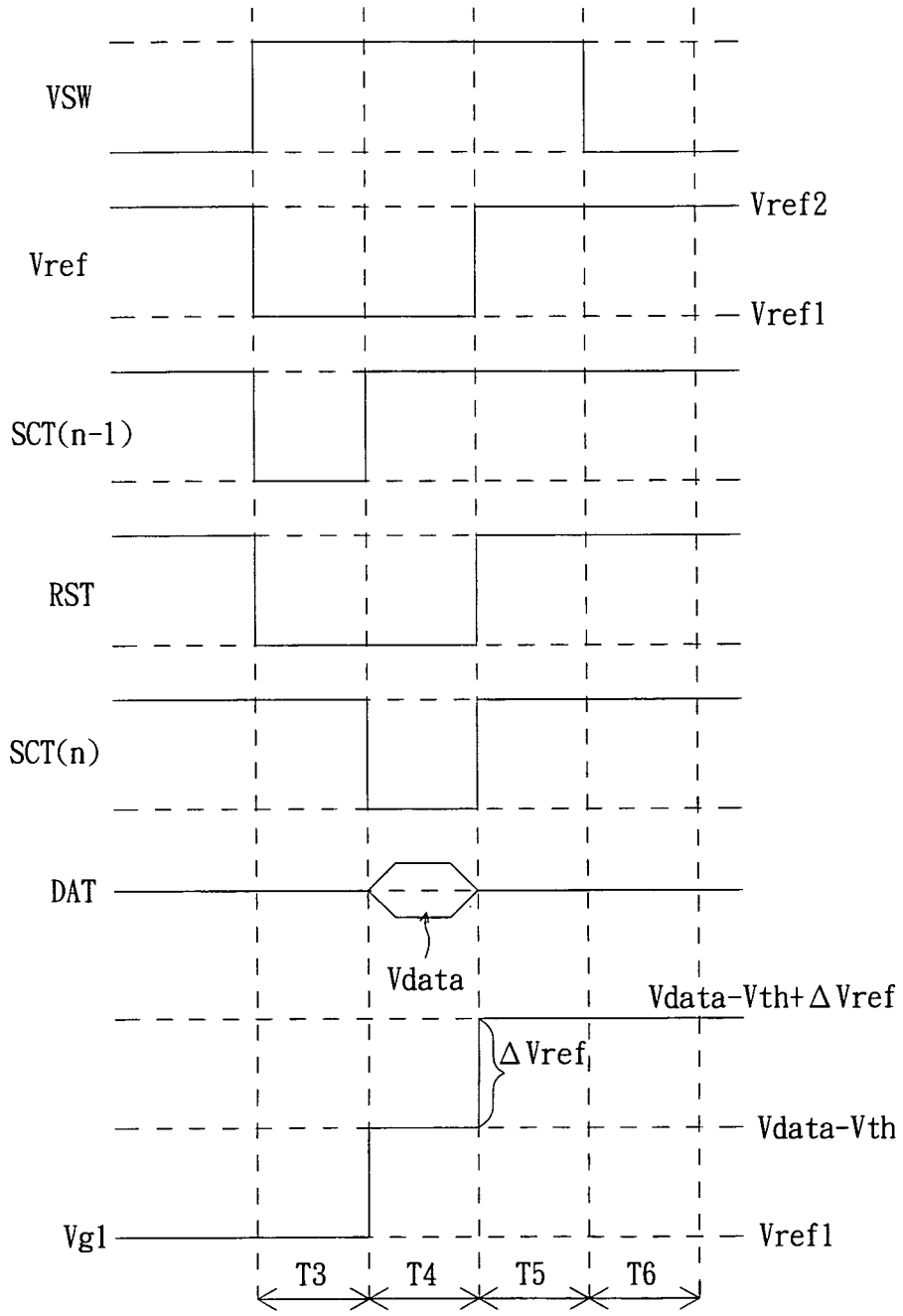
FIG. 8 is a timing diagram relating to operation of the second pixel structure.

Referring to FIG. 8, a timing diagram relating to operation of the second pixel structure 210(2) is shown. The timing diagram of FIG. 8 includes periods T3~T6.

In period T3, the power switch signal VSW has a high voltage level such that the second transistor MP2 is turned off. The present scan signal SCT(n) is also at the high level such that the third transistor MP3 is turned off. The previous scan signal SCT(n−1) and reset signal RST are at a low level such that the fourth transistor MP4 and fifth transistor MP5 are turned on. The reference voltage signal Vref is equal to the first reference voltage Vref1 and thus the voltage of the negative end of the capacitor C3 is set at the first reference voltage Vref1 and the gate voltage Vg1 of the transistor MP1 is equal to Vref1.

In the period T4 of the second pixel structure 210(2), the power switch signal VSW has a high voltage level such that the second transistor MP2 remains off. The previous scan signal SCT(n−1) transitions to a high voltage level such that the fourth transistor MP4 is turned off. The reset signal RST is still at a low voltage level such that the fifth transistor MP5 remains on. The present scan signal SCT(n) is activated to a low voltage level such that the third transistor MP3 is turned on. The pixel data voltage Vdata is inputted to the drain of the first transistor MP1 via the third transistor MP3 such that Vd1=Vdata and the gate voltage Vg1 of the transistor MP1 is reset to be (Vdata−Vth). The reference voltage signal Vref is still the first reference voltage Vref1, and thus the voltage of the negative end of the capacitor C3 remains to be the first reference voltage Vref1 such that the capacitor C3 has a storage voltage Vc3=Vg1−Vref1=Vdata−Vth−Vref1.

Since the present scan signal SCT(n) needs only to have a period length equal to that of the pixel data voltage Vdata, the display device 60 can have a higher frame response speed to provide better image quality.

In period T5, the power switch signal VSW and scan signal SCT(n−1) remain at a high level such that the second transistor MP2 and fourth transistor MP4 remain off. The present scan signal SCT(n) and reset signal RST transition to a high voltage level such that the third transistor MP3 and fifth transistor MP5 are turned off. Also, the reference voltage signal Vref is switched to be the second reference voltage Vref2 such that the voltage of the negative end of the capacitor C3 is changed to the second reference voltage Vref2. Since the capacitor C3 had a storage voltage Vc3=Vdata−Vth−Vref1 in period T4, the first transistor MP1 has a gate voltage Vg1 set to Vg1=Vref2+Vc3=Vref2+Vdata−Vth−Vref1=Vdata−Vth+ΔVref, where Vdata−Vth+ΔVref is a set voltage.

In period T6, the present scan signal SCT(n), previous scan signal SCT(n−1) and reset signal RST remain at a high level such that the third transistor MP3, fourth transistor MP4 and fifth transistor MP5 remain off. The power switch signal VSW transitions to have a low voltage level such that the second transistor MP2 is turned on. The source of the first transistor MP1 is then coupled to the source voltage Vdd2 such that Vs1=Vdd2. Since the gate voltage Vg1 of the transistor MP1 was set to (Vdata−Vth+ΔVref) in the period T5, the voltage Vsg1 across the source and drain of the first transistor MP1 is equal to Vdd2−Vg1=Vdd2−(Vref2+Vdata−Vth−Vref1)=Vdd2−Vdata−ΔVref+Vth and thus the current I2 through the light element D2 is $K\times(Vsg1-Vth)^2=K\times(Vdd2-Vdata-\Delta Vref+Vth-Vth)^2=K\times(Vdd2-Vdata-\Delta Vref)^2$.

Again, note that I2 is independent of Vth so that variations of the threshold voltage of transistors MP1 in different pixels do not cause brightness variation.

In the above second embodiment, when the previous scan signal SCT(n−1) is activated (time period T3), the gate voltage of the first transistor MP1 is changed beforehand. When the present scan SCT(n) is subsequently activated, the pixel 210 quickly completes the compensation for the threshold voltage Vth of the first transistor MP1 to speed up the frame response of the display device 60 and thus improve the image quality of the display device 60.

Embodiment Three

Figure 9:
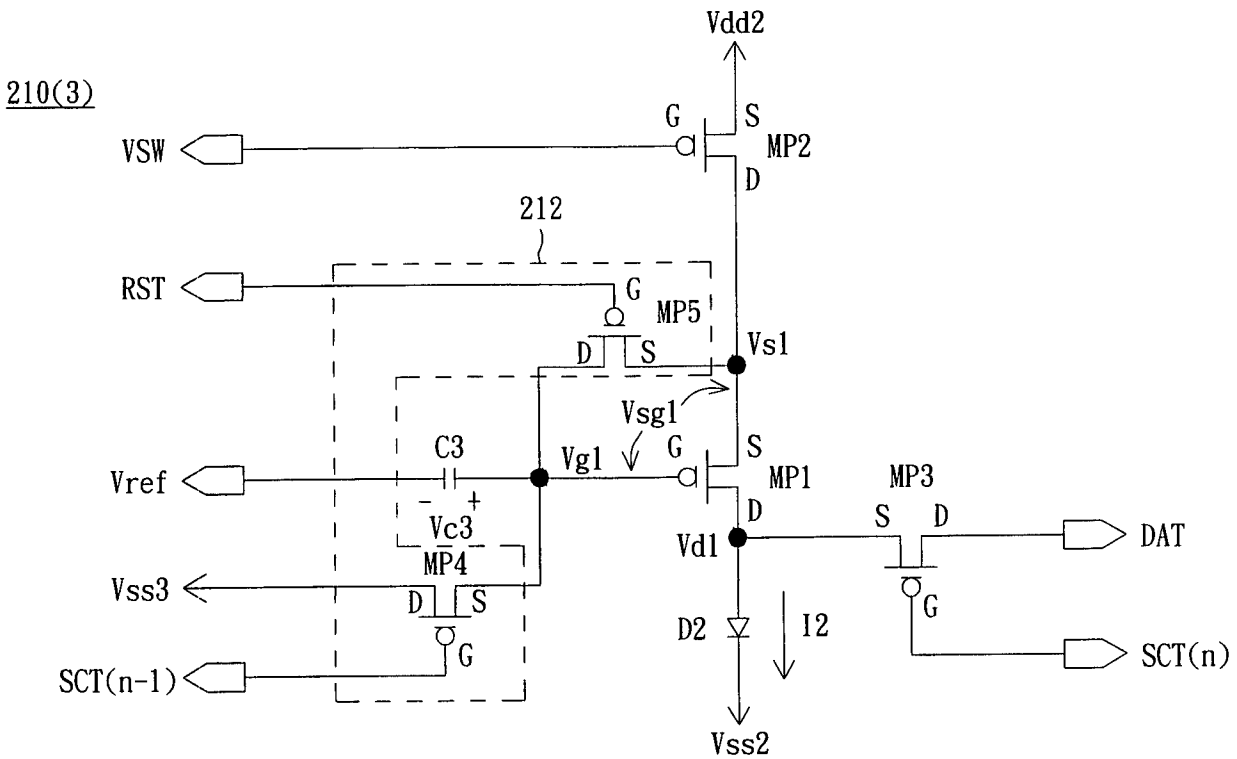
FIG. 9 is a circuit diagram of a third pixel structure according to a third embodiment of the invention.

Referring to FIG. 9, a circuit diagram of a third pixel structure 210(3) according to a third embodiment of the invention is shown. The difference between the third pixel structure 210(3) and the second pixel structure 210(2) is that in the third pixel structure 210(3), the fourth transistor MP4 is changed to have a drain coupled to a source voltage Vss3 (instead of Vref as in FIG. 7). As with the other embodiments, the third pixel structure 210(3) can also set the current I2 flowing through the light element D2 to be K×(Vdd2−Vdata−

$\Delta Vref)^2$ such that the current I2 will not be affected by the variation of the threshold voltage Vth according to the timing diagram of FIG. 8.

Embodiment Four

Figure 10:
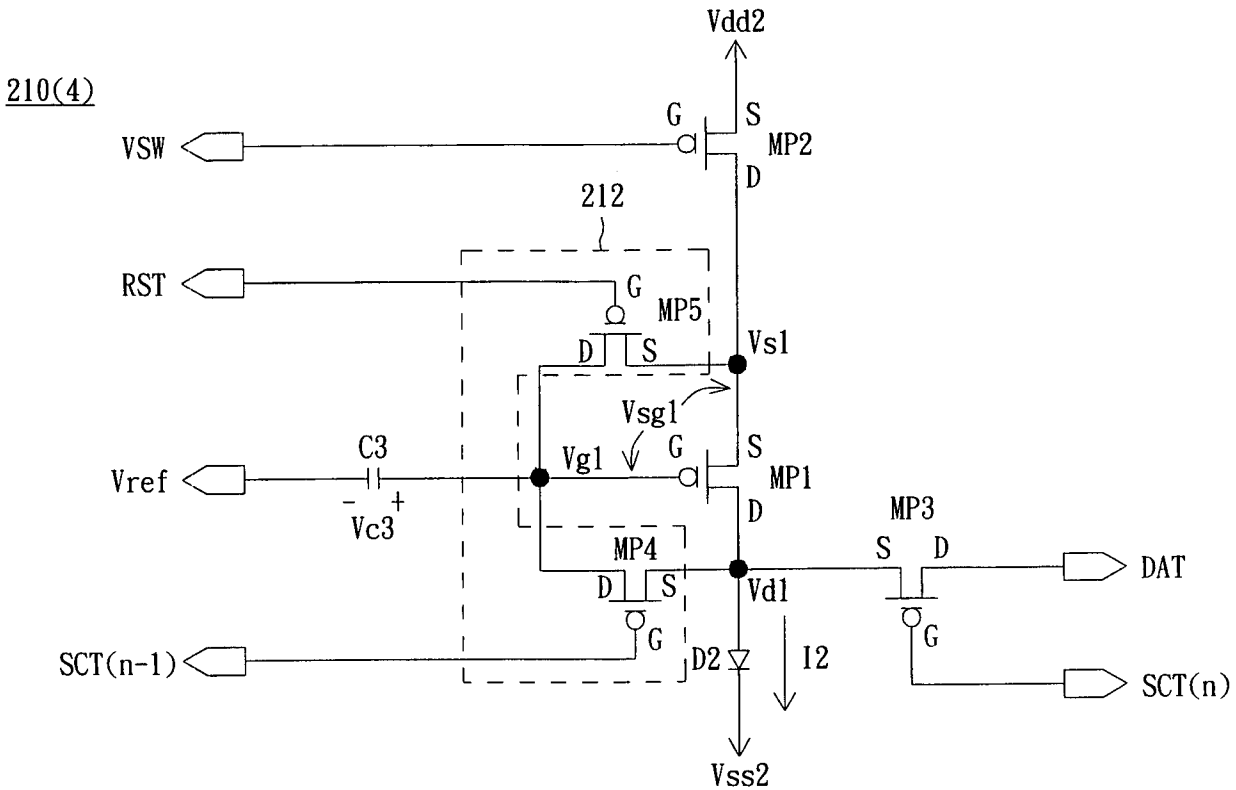
FIG. 10 is a circuit diagram of a fourth pixel structure according to a fourth embodiment of the invention.

Referring to FIG. 10, a circuit diagram of a fourth pixel structure 210(4) according to a fourth embodiment of the invention is shown. The difference between the fourth pixel structure 210(4) and the third pixel structure 210(3) is that in the fourth pixel structure 210(4), the fourth transistor MP4 is changed to have a drain coupled to the gate of the first transistor MP1, the drain of the fifth transistor MP5 and one end of the capacitor C3. The source of the fourth transistor MP4 is changed to couple to the drain of the first transistor MP1, the source of the third transistor MP3 and the positive end of the light element D2.

Figure 11:
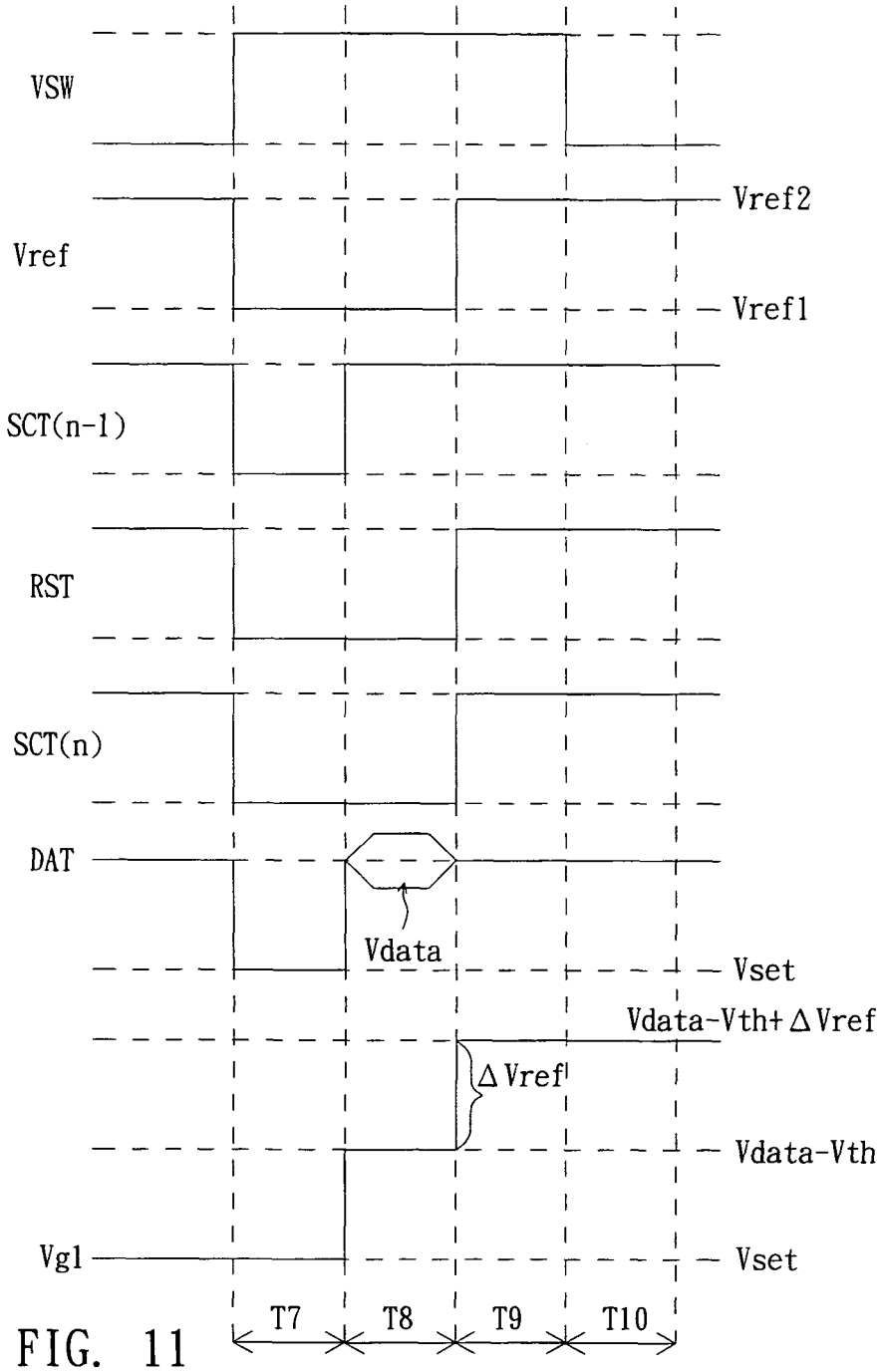
FIG. 11 is a timing diagram relating to operation of the fourth pixel structure.

Referring to FIG. 11, a timing diagram relating to operation of the fourth pixel structure 210(4) is shown, in which the timing diagram includes periods T7~T10.

In period T7, the reference voltage signal Vref is equal to the first reference voltage Vref1. The power switch signal VSW is at a high voltage level such that the second transistor MP2 is turned off. Moreover, the present scan signal SCT(n), previous scan signal SCT(n−1) and reset signal RST are at a low voltage level such that the third transistor MP3, fourth transistor MP4 and fifth transistor MP5 are turned on. In period T7, the voltage level of the data line 310 is Vset (a low voltage, for example) and thus Vset is inputted to the drain of the first transistor MP1 via the third transistor MP3 such that the gate voltage Vg1 of the first transistor MP1 is Vset.

In period T8, the power switch signal VSW remains at a high voltage level such that the second transistor MP2 continues to be off. The previous scan signal SCT(n−1) transitions to a high voltage level such that the fourth transistor MP4 is turned off. The present scan signal SCT(n) and reset signal RST remain at a low voltage level such that the third transistor MP3 and fifth transistor MP5 continue to be on. The voltage level of the data line 310 is changed to the pixel data voltage Vdata, and thus the pixel data voltage Vdata is inputted to the drain of the first transistor MP1 via the third transistor MP3 such that the gate voltage Vg1 of the transistor MP1 is reset to be (Vdata−Vth). The reference voltage signal Vref is still at the first reference voltage Vref1. Therefore, the voltage of the negative end of the capacitor C3 remains to be the first reference voltage Vref1 such that the capacitor C3 has a storage voltage Vc3=Vg1−Vref1=Vdata−Vth−Vref1.

In period T9, the power switch signal VSW and scan signal SCT(n−1) remain at a high level such that the second transistor MP2 and fourth transistor MP4 continue to be off. The present scan signal SCT(n) and reset signal RST transition to a high voltage level such that the third transistor MP3 and fifth transistor MP5 are turned off. The reference voltage signal Vref is switched to the second reference voltage Vref2 such that the voltage of the negative end of the capacitor C3 is changed to the second reference voltage Vref2. Because the capacitor C3 has a storage voltage Vc3=Vdata−Vth−Vref1 in period T8, the first transistor MP1 has a gate voltage Vg1 set to be Vg1=Vref2+Vc3=Vref2+Vdata−Vth−Vref1=Vdata−Vth+ΔVref.

In period T10, the present scan signal SCT(n), previous scan signal SCT(n−1) and reset signal RST remain at a high level such that the third transistor MP3, fourth transistor MP4 and fifth transistor MP5 continue to be off. The power switch signal VSW transitions to a low voltage level such that the second transistor MP2 is turned on. The first transistor MP1 has a source coupled to the source voltage Vdd2 such that Vs1=Vdd2. Since the gate voltage Vg1 of the transistor MP1 was set to be Vdata−Vth+ΔVref in period T9, the voltage Vsg1 across the source and drain of the first transistor MP1 is set, in period T10, equal to Vdd2−Vg1=Vdd2−(Vref2+Vdata−Vth−Vref1)=Vdd2−Vdata−ΔVref+Vth. As a result the current I2 through the light element D2 is $K\times(Vsg1-Vth)^2=K\times(Vdd2-Vdata-\Delta Vref+Vth-Vth)^2=K\times(Vdd2-Vdata-\Delta Vref)^2$. Therefore, the current I2 is not affected by the variation of the threshold voltage Vth of transistor MP1.

Embodiment Five

Figure 12:
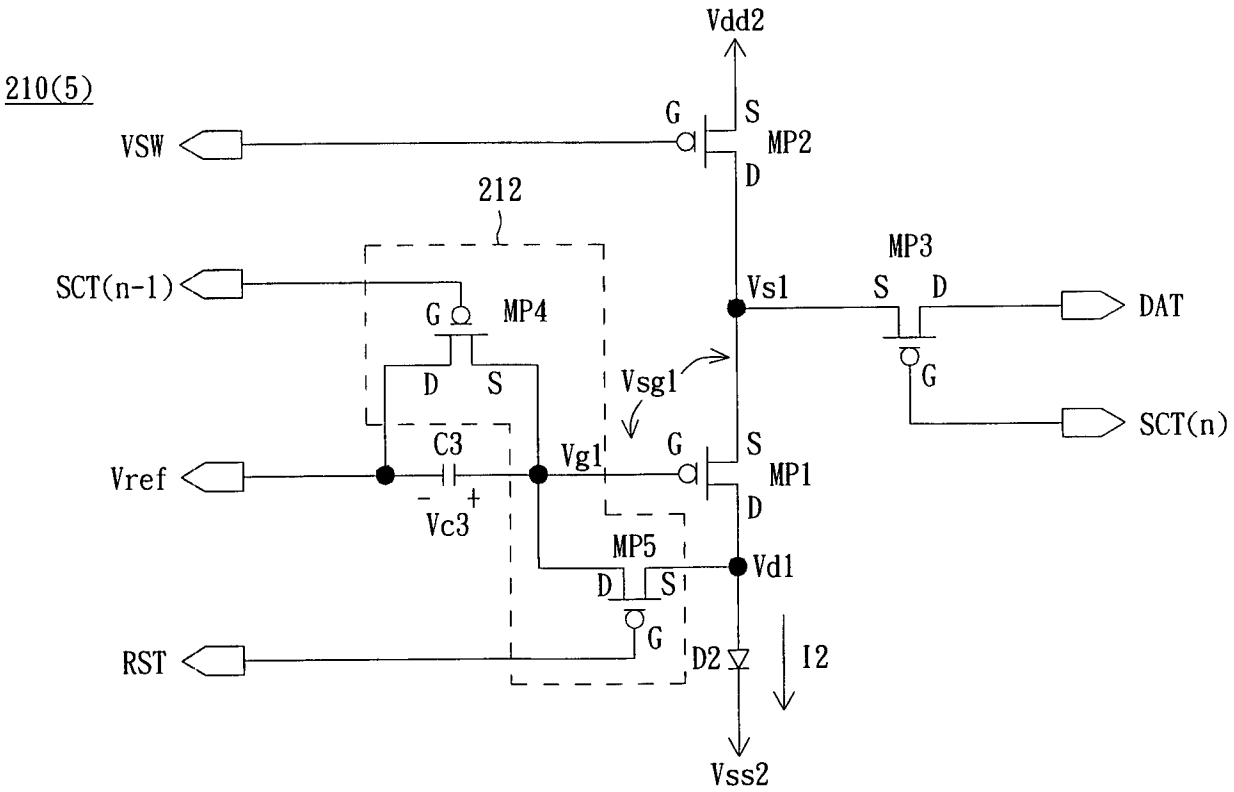
FIG. 12 is a circuit diagram of a fifth pixel structure according to a fifth embodiment of the invention.

Referring to FIG. 12, a circuit diagram of a fifth pixel structure 210(5) according to a fifth embodiment of the invention is shown. The difference between the fifth pixel structure 210(5) and the fourth pixel structure 210(4) is that in the fifth pixel structure 210(5), the fourth transistor MP4 of the fifth pixel structure 210(5) is changed to have a drain for receiving the reference voltage signal Vref, and a source coupled to the gate of the first transistor MP1, one end of the capacitor C3 and the drain of the fifth transistor MP5. The fifth transistor MP5 is changed to have the source coupled to the drain of the first transistor MP1 and the positive end of the light element D2. The pixel 250 of the fifth embodiment can also set the current I2 flowing through the light element D2 to be $K\times(Vdd2-Vdata-\Delta Vref)^2$ such that the current I2 will not be affected by the variation of the threshold voltage Vth according to the timing diagram of FIG. 11.

Embodiment Six

Figure 13:
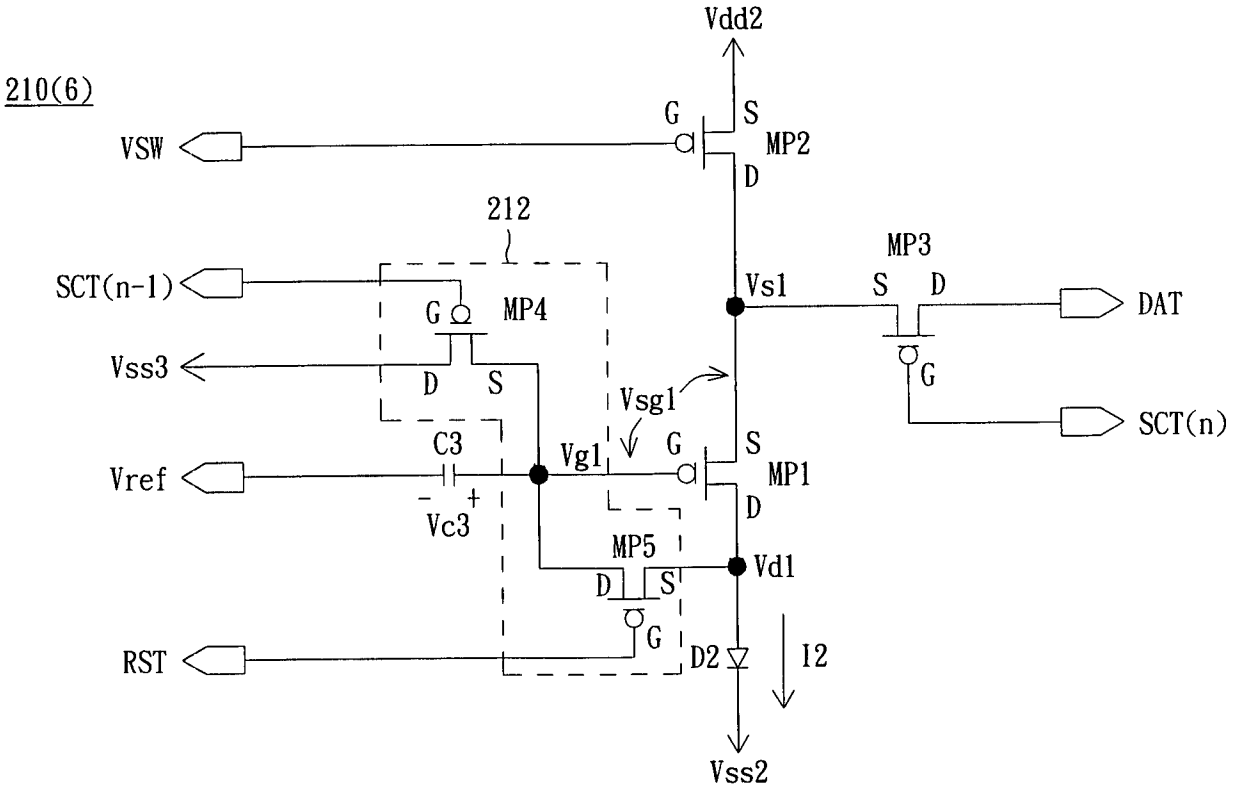
FIG. 13 is a circuit diagram of a sixth pixel structure according to a sixth embodiment of the invention.

Referring to FIG. 13, a circuit diagram of a sixth pixel structure 210(6) according to a sixth embodiment of the invention is shown. The difference between the sixth pixel structure 210(6) and the fifth pixel structure 210(5) lies in the fourth transistor MP4 of the sixth pixel structure 210(6) is changed to have a drain coupled to a source voltage Vss3 and the sixth pixel structure 210(6) can also set the current I2 flowing through the light element D2 to be $K\times(Vdd2-Vdata-\Delta Vref)^2$ such that the current I2 will not be affected by the variation of the threshold voltage Vth according to the timing diagram of FIG. 11.

Embodiment Seven

Figure 14:
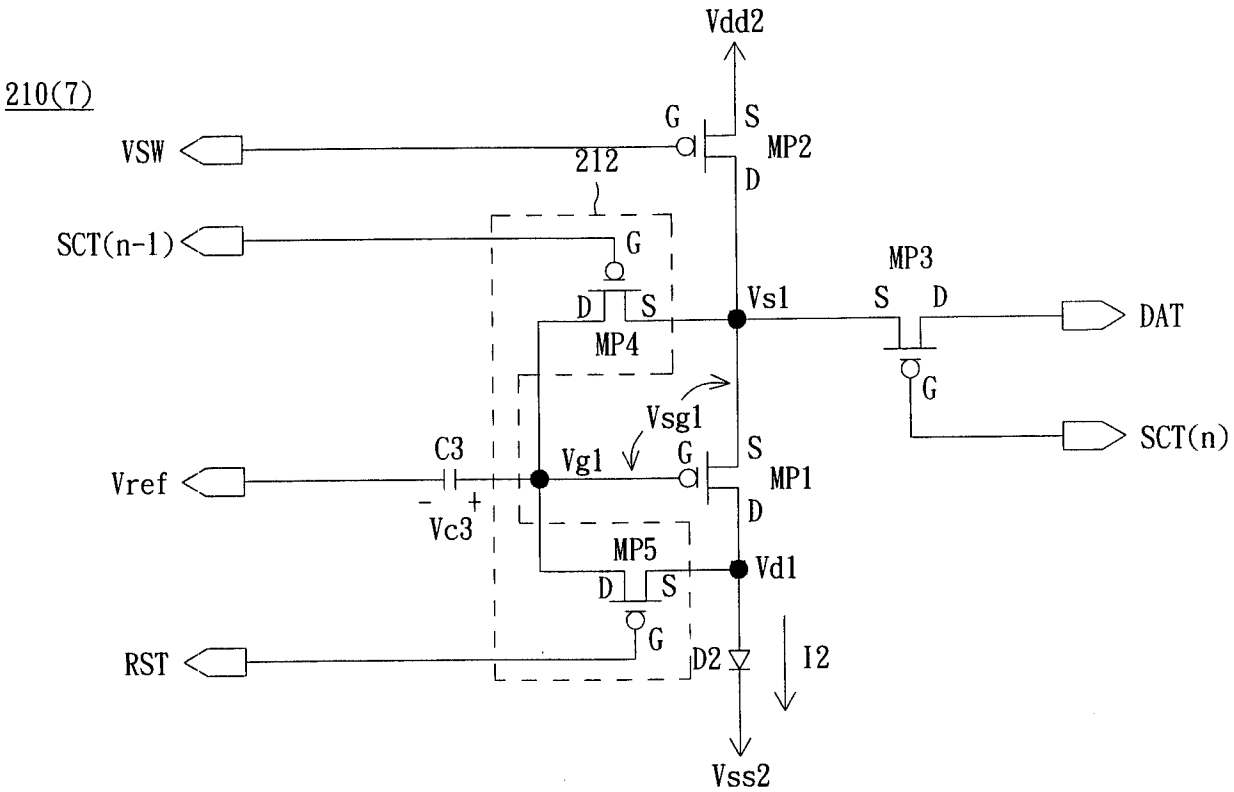
FIG. 14 is a circuit diagram of a seventh pixel structure according to a seventh embodiment of the invention.

Referring to FIG. 14, a circuit diagram of a seventh pixel structure 210(7) according to a seventh embodiment of the invention is shown. The difference between the seventh pixel structure 210(7) and the sixth pixel structure 210(6) is that in the seventh pixel structure, the fourth transistor MP4 of the seventh pixel structure 210(7) is changed to have a drain coupled to one end of the capacitor C3, the gate of the first transistor MP1 and the drain of the fifth transistor MP5, and a source coupled to the source of the first transistor MP1, the drain of the second transistor MP2 and the source of the third transistor MP3. The seventh pixel structure 210(7) can also set the current I2 flowing through the light element D2 to be $K\times(Vdd2-Vdata-\Delta Vref)^2$ such that the current I2 will not affected by the variation of the threshold voltage Vth according to the timing diagram of FIG. 11.

Figure 15:
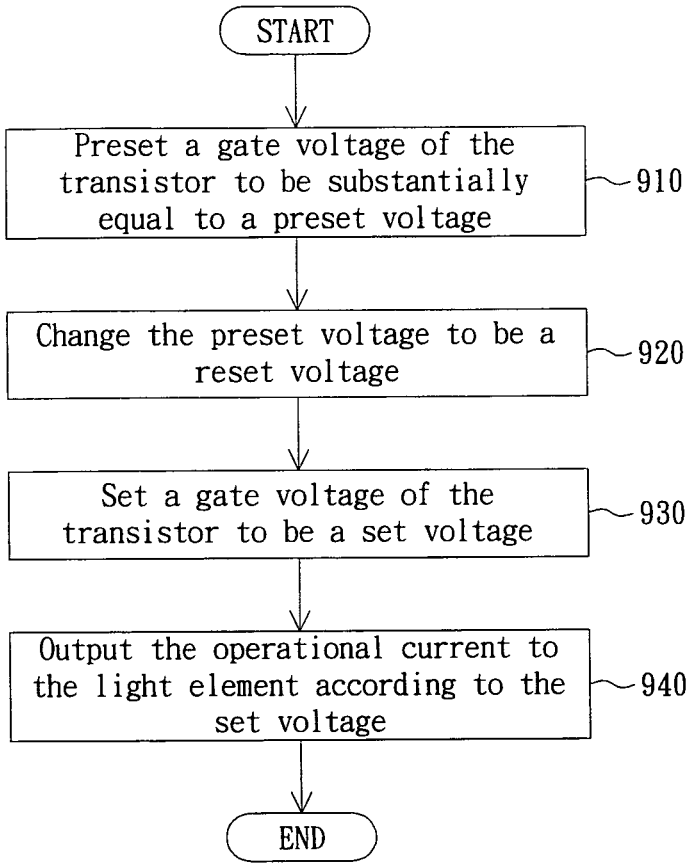
FIG. 15 is a flow chart of a method for driving a pixel of a display device, in accordance with an embodiment.

Referring to FIG. 15, a flow chart of a method for driving a pixel of a display device is shown. The driving method is applied to the above pixel structures 210(1)~210(7), each of which includes the first transistor MP1 and the light element D2. The first transistor MP1 is for controlling the operational current I2 through the light element D2. The driving method includes the following steps. First, in step 910, preset the gate voltage of the first transistor MP1 to be substantially equal to a preset voltage—(Vth−ΔVref) in FIG. 5, the first reference voltage Vref1 in FIG. 8 and Vset in FIG. 11). Following that, in step 920, input the pixel data voltage Vdata to the source or drain of the first transistor MP1 via the transistor MP3 such that the preset voltage is changed to a reset voltage. The reset voltage is obtained according to the pixel data voltage Vdata and threshold voltage Vth. Next, in step 930, set the gate voltage of the first transistor MP1 to be a set voltage. The set voltage is obtained according to the reset voltage and reference voltage signal Vref. Finally, in step 940, the first transistor outputs the operational current I2 to the light element D2 according to the set voltage.

As mentioned above, although the transistors are exemplified to be p-type TFTs for illustration, n-type TFTs can also be used to achieve the purpose of the invention instead of the p-type TFTs.

The display apparatus and pixel driving method thereof disclosed by the above embodiments of the invention may have the following advantages by changing the gate voltage of the first transistor beforehand:

First, the drawback of uneven (brightness) frame display of OLED display devices, such as Mura, is avoided. Because the reset circuit of a pixel structure provides a mechanism for compensating for the threshold voltage of the transistor that provides current to the light element, the current I2 flowing through the light element in the end is $K\times(Vdd2-Vdata-\Delta Vref)^2$, and thus the current I2 will not be affected by variation of the threshold voltage and the OLED display device can display a better quality frame.

Moreover, the response speed of the OLED display device is increased. Because each scan signal needs to only have the same period length as that of the to-be-written pixel data voltage, operation time for the scan driver to drive each row of pixels can be reduced to speed up the frame response of the display device.

In addition, the operational range of the pixel data voltage outputted by the data driver and source voltages coupled to the pixels can be increased. Because the value ΔVref is adjustable, the pixel data voltage and source voltages can have a larger adjustable range.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A display device comprising:

a pixel structure comprising:

a first transistor having a gate, a drain, and a source;

circuitry to:

initially set the first transistor gate at a first voltage, in response to a data signal received over a data line of the display device, set the first transistor gate at a second voltage, transition the first transistor gate voltage from the second voltage to a third voltage that is higher than the second voltage by a reference voltage; and a light element coupled to the first transistor and configured to emit light in response to a current through the light element, wherein the circuitry further comprises:

a second transistor for inputting a first source voltage to the source of the first transistor according to a power switch signal; and a third transistor for inputting the data signal directly to a terminal where the first transistor is serially connected with the second transistor or a terminal where the first transistor is serially connected with the light element a fourth transistor, comprising a first terminal, a second terminal and a control terminal, the first terminal connected to the gate of the first transistor, the second terminal directly connected to the drain of the first transistor and the control terminal of the fourth transistor being used for receiving a reset signal, wherein the first transistor is associated with a threshold voltage, and wherein the second voltage is equal to a voltage of the data signal less the threshold voltage, and the first voltage is a preset voltage less than the second voltage.

2. The display device according to claim 1, wherein the light element includes an organic light emitting diode (OLED).

3. The display device according to claim 1, wherein the reference voltage is equal to a difference between a first reference voltage and a second reference voltage.

4. The display device according to claim 1, wherein the scan signal comprises a first scan signal received over a first scan line, and the circuitry further comprises a fifth transistor having a gate to receive a second scan signal received over a second scan line.

5. The display device according to claim 1, wherein the second voltage is derived based on the voltage of the data signal less the threshold voltage.

6. A display device, comprising at least a pixel, the pixel comprising:

a light element;

a first transistor for outputting an operational current to the light element;

a second transistor for inputting a first source voltage to a first terminal of the first transistor according to a power switch signal;

a third transistor for inputting a pixel data voltage directly to a terminal where the first transistor is serially connected with the second transistor or a terminal where the first transistor is serially connected with the light element according to a present scan signal;

a fourth transistor, comprising a first terminal, a second terminal and a control terminal, the first terminal of the fourth transistor connected to a control terminal of the first transistor; the second terminal of the fourth transistor directly connected to a second terminal of the first transistor, the control terminal being used for receiving a reset signal;

a reset circuit for resetting a voltage of the control terminal of the first transistor to a reset voltage, the reset voltage being obtained according to the pixel data voltage and a threshold voltage of the first transistor; and a capacitor, having one end coupled to the control terminal of the first transistor and the other end coupled to a reference voltage signal for setting the voltage of the control terminal of the first transistor to a set voltage, the set voltage being obtained according to the reset voltage and the reference voltage signal;

wherein the first transistor is configured to output the operational current to the light element according to the set voltage, wherein the reference voltage signal is switched between a first reference voltage and a second reference voltage in an operational period, when the reference voltage signal is switched from the first reference voltage to the second reference voltage, the voltage of the control terminal of the first transistor is substantially equal to the set voltage, and the set voltage is equal to the reset voltage plus a difference between the second reference voltage and the first reference voltage.

7. The display device according to claim 6, wherein the light element is an organic light emitting diode (OLED).

8. The display device according to claim 6, wherein the reset voltage is substantially equal to the pixel data voltage subtracted by the threshold voltage.

9. The display device according to claim 6, wherein the first terminal of the first transistor is coupled to a second terminal of the second transistor, a first terminal of the second transistor is coupled to the first source voltage, a control terminal of the second transistor is for receiving the power switch signal, the light element has a negative end coupled to a second source voltage and a positive end coupled to the second terminal of the first transistor, and the third transistor has a control terminal for receiving the present scan signal and a second terminal for receiving the pixel data voltage.

10. The display device according to claim 6, wherein the set voltage is higher than the reset voltage by a voltage of the reference voltage signal.

11. A display device comprising at least a pixel, the pixel comprising:

a light element;

a first transistor for outputting an operational current to the light element;

a second transistor for inputting a first source voltage to a first terminal of the first transistor according to a power switch signal;

a third transistor for inputting a pixel data voltage directly to a terminal where the first transistor is serially connected with the second transistor or a terminal where the first transistor is serially connected with the light element according to a present scan signal;

a fourth transistor, comprising a first terminal, a second terminal and a control terminal, the first terminal of the fourth transistor connected to a control terminal of the first transistor; the second terminal of the fourth transistor directly connected to a second terminal of the first transistor, the control terminal of the fourth transistor being used for receiving a reset signal;

a reset circuit for resetting a voltage of the control terminal of the first transistor to be a reset voltage, the reset voltage being obtained according to the pixel data voltage and a threshold voltage of the first voltage; and a capacitor having one end coupled to the control terminal of the first transistor and the other end coupled to a reference voltage signal for setting the voltage of the control terminal of the first transistor to be a set voltage, the set voltage being obtained according to the reset voltage and the reference voltage signal;

wherein the first transistor is configured to output the operational current to the light element according to the set voltage, wherein the reference voltage signal is switched between a first reference voltage and a second reference voltage in an operational period, when the reference voltage signal is switched from the first reference voltage to the second reference voltage, the voltage of the control terminal of the first transistor is substantially equal to the set voltage, and the set voltage is equal to the reset voltage plus a difference between the second reference voltage and the first reference voltage.

12. The display device according to claim 11, wherein the light element is an OLED.

13. The display device according to claim 11, wherein the reset voltage is substantially equal to the pixel data voltage subtracted by the threshold voltage.

14. The display device according to claim 11, wherein the first terminal of the first transistor is coupled to a second terminal of the second transistor, the third transistor has a control terminal for receiving the present scan signal and a second terminal for receiving the pixel data voltage, a first terminal of the second transistor is coupled to the first source voltage, a control terminal of the second transistor is for receiving the power switch signal, the light element has a negative end coupled to a second source voltage and a positive end coupled to the second terminal of the first transistor.

15. The display device according to claim 11, wherein the reset circuit comprises:

a fifth transistor, comprising:

a first terminal, for receiving a third source voltage;

a second terminal, coupled to the control terminal of the first transistor; and a control terminal, for receiving a previous scan signal.

16. The display device according to claim 11, wherein the set voltage is higher than the reset voltage by a voltage of the reference voltage signal.

17. A method for driving a display device, the method comprising:

providing a pixel comprising at least a first transistor, a second transistor, a third transistor and a light element, the first transistor used for controlling an operational current through the light element, the second transistor used for inputting a first source voltage to a first terminal of the first transistor according to a power switch signal, a first terminal of the third transistor connected to a control terminal of the first transistor; a second terminal of the third transistor directly connected to a second terminal of the first transistor, a control terminal of the third transistor being used for receiving a reset signal;

presetting the control terminal of the first transistor to be substantially equal to a preset voltage;

inputting a pixel data voltage to a terminal where the first transistor is serially connected with the second transistor or a terminal where the first transistor is serially connected with the light element such that the preset voltage is changed to a reset voltage, wherein the reset voltage is obtained according to the pixel data voltage and a threshold voltage of the first transistor;

setting a voltage of the control terminal of the first transistor to be a set voltage, wherein the set voltage is obtained according to the reset voltage and a reference voltage signal; and outputting the operational current to the light element according to the set voltage, wherein when the reference voltage signal is changed from a first reference voltage to a second reference voltage, the voltage of the control terminal of the first transistor is substantially equal to the set voltage, and wherein the reference voltage signal is switched between the first reference voltage and the second reference voltage in an operational period, when the reference voltage signal is switched from the first reference voltage to the second reference voltage, the set voltage is equal to the reset voltage plus a difference between the second reference voltage and the first reference voltage.

18. The method according to claim 17, wherein the light element is an OLED.

19. The method according to claim 17, wherein the reset voltage is substantially equal to the pixel data voltage subtracted by the threshold voltage.

20. The method according to claim 17, wherein the set voltage is higher than the reset voltage by a voltage of the reference voltage signal.

* * * * *